United States Patent [19]

Galle

[11] Patent Number: 4,869,615

[45] Date of Patent: Sep. 26, 1989

[54] TENSION LEG JOINT

[75] Inventor: Gary L. Galle, Houston, Tex.

[73] Assignee: Cameron Iron Works, USA, Inc., Houston, Tex.

[21] Appl. No.: 172,191

[22] Filed: Mar. 23, 1988

[51] Int. Cl.[4] ..... E02D 5/54; F16G 11/00; F16L 35/00

[52] U.S. Cl. ..... 403/11; 285/321; 403/321; 405/224; 294/86.25

[58] Field of Search ..... 403/321, 322, 326, 11; 405/224; 285/321, 18; 294/86.25

[56] References Cited

U.S. PATENT DOCUMENTS

| | | | |
|---|---|---|---|
| 3,071,188 | 1/1963 | Raulins | 285/23 |
| 3,448,799 | 6/1969 | Ahlstone | 166/346 |
| 3,452,815 | 7/1969 | Watkins | 166/344 |
| 4,045,054 | 8/1977 | Arnold | 285/18 |
| 4,451,056 | 5/1984 | Galle, Jr. | 285/3 |
| 4,459,931 | 7/1984 | Glidden | 405/224 X |
| 4,611,953 | 9/1986 | Owens | 405/224 |
| 4,643,466 | 2/1987 | Conner | 285/321 |
| 4,651,818 | 3/1987 | Johnson | 166/115 |
| 4,664,558 | 5/1987 | De Meio | 285/18 X |

FOREIGN PATENT DOCUMENTS

| | | | |
|---|---|---|---|
| 0654535 | 11/1964 | Belgium | 285/321 |
| 0417673 | 2/1974 | U.S.S.R. | 285/321 |

*Primary Examiner*—Andrew V. Kundrat
*Assistant Examiner*—Paul M. Frechette

[57] ABSTRACT

An improved tension leg joint with a first or receptacle member having an opening to receive the second or tension leg member end, the first member opening includes an internal recess including an upper downwardly facing shoulder and a lower shoulder, the second member end includes a latching element carried on a lower upwardly facing shoulder of the second member and normally biased outward so that it moves into the internal recess of the first member when the second member end is inserted therein sufficiently far so that the latching element moves past the downwardly facing shoulder, and a release sleeve movable within the first member recess and having means for releasably engaging the latching element when it is moved into the interior of the release sleeve subsequent lifting of the second member and its latching element causes the release sleeve to be raised to engage the downwardly facing recess shoulder and allow the latching element to pass thereby in its upward movement without coming into latching engagement therewith.

8 Claims, 12 Drawing Sheets

TENSION LEG JOINT

BACKGROUND

The present invention relates to an improved joint for a tension leg and particularly to a releasable latch for such joint which can be set and released by simple axial movement of the inner leg member.

In current operations offshore platforms are used which have buoyancy and are held in place by tension legs which are secured to a receptacle mounted on a template on the sea floor. It is inherent in such platforms that the legs which connect between the sea floor receptacle and the floating platform are maintained in tension to increase the stability of the platform. Such tension mooring has involved the use of cables, tubular members and solid members as the tension mooring elements. The present invention relates to an improved tension leg joint which allows quick and simple connection between connecting joint members and easy and positive release of the connecting latch mechanism by lowering the upper member.

U.S. Pat. No. 3,452,815 discloses a latching mechanism for connecting lines run from a floating vessel to a subsea well which includes latching dogs to coact with a circumferential groove in the post or mandrel and carried by and other member and including an actuator means to block the dogs in latched position and preset means including a the use of a weight dropped from the surface to engage and move the actuator to a latch releasing position. U.S. Pat. No. 4,651,818 discloses a tubing plug which is latched by dogs being cammed into an internal recess within the tubular member in which the plug is to seat. The cam is a sleeve sliding on the rod mandrel for locking and releasing the dogs from their latched position.

U.S. Pat. No. 4,611,953 discloses a tension leg platform tendon bottom connector. This structure provides a connection from a tubular tension leg tendon into the receptacle in the anchor template located on the sea floor. This connection includes dogs which are used to engage within an internal recess in the receptacle and keys which when lowered into the recess cause relative movement of the dogs to move then into an inactive position allowing removal of the tendon from the receptacle. This is accomplished because the dogs are mounted on a carrier sleeve and the keys are mounted from the body but in position to engage a ring connected to the carrier sleeve so that when the keys pass upwardly past the internal recess they move the carrier sleeve upwardly and the dogs are brought upwardly into retracted position so that the assembly may be retrieved from the receptacle. U.S. Pat. No. 4,451,056 discloses another underwater tension connector for use in an offshore mooring system.

U.S. Pat. No. 3,448,799 discloses a well completion unit which utilizes cam actuated locking dogs to provide the clamping connection between the Christmas tree and flowline in a subsea well.

U.S. Pat. No. 3,071,188 discloses the use of a ring having depending flexible latching fingers which engage within external grooves in a tubular member and when engaged a sleeve is moved into surrounding relationship to the exterior of the fingers to secure them in their latching position.

SUMMARY

The present invention includes an improved tension leg joint in which the first or receptacle member includes an opening to receive the second or tension leg member, the first member opening includes an internal recess including an upper downwardly facing shoulder and a lower shoulder, the second member end includes a latching element carried on a lower upwardly facing shoulder of the second member and normally biased outward so that it moves into the internal recess of the first member when the second member end is inserted therein sufficiently far so that the latching element moves past the downwardly facing shoulder, and a release sleeve movable within the first member recess and having means for releasably engaging the latching element when it is moved into the interior of the release sleeve subsequent lifting of the second member and its latching element causes the release sleeve to be raised to engage the downwardly facing recess shoulder and allow the latching element to pass thereby in its upward movement without coming into latching engagement therewith.

An object of the present invention is to provide an improved tension leg joint which is easy to connect into latched position and easy to release and retrieve from latched position.

Another object is to provide an improved tension leg joint having a simple structure which does not rely upon springs for the release of the latching member from its latched position.

Still another object is to provide an improved tension leg joint which is easy to manufacture and free of complex movable parts.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
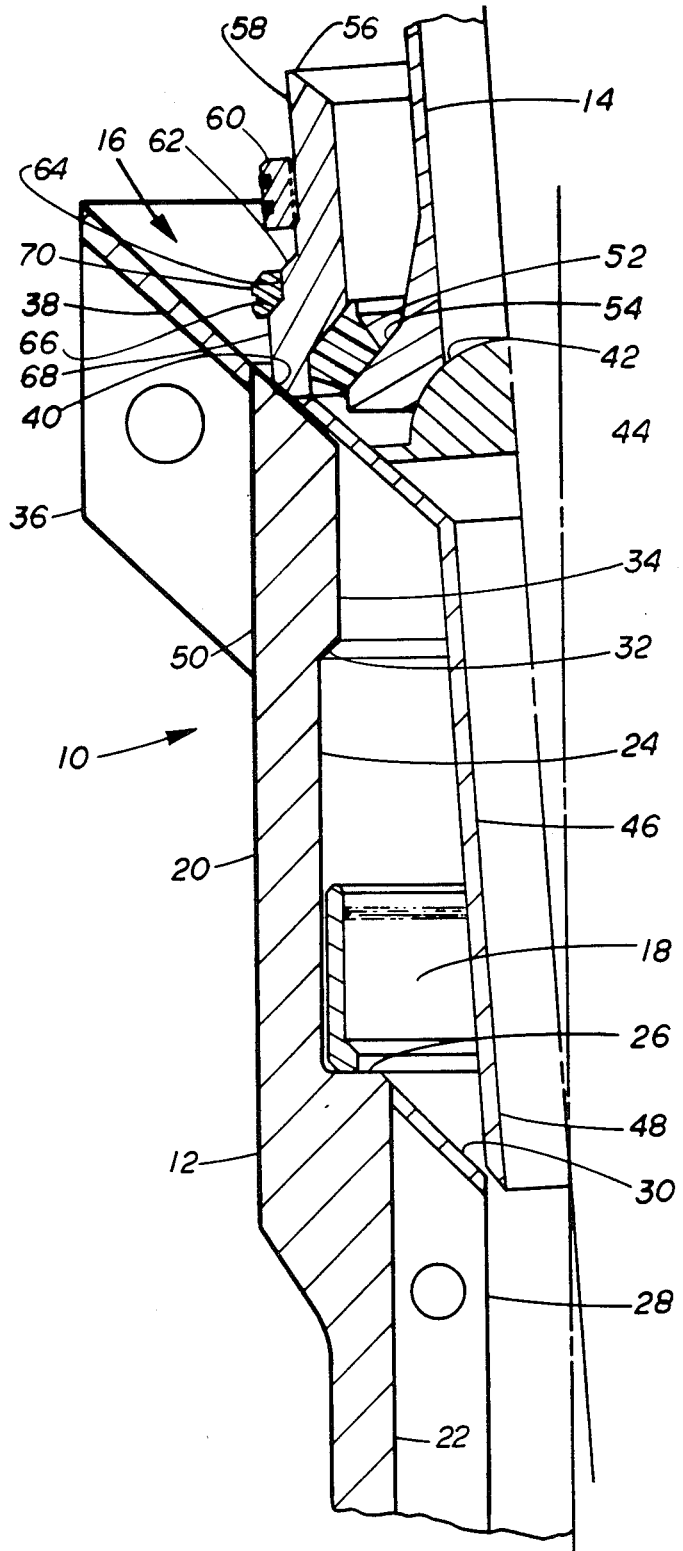
FIG. 1 is a partial sectional view of one form of the improved joint of the present invention illustrating the position of the components as their joining is commenced.

As shown in FIG. 1, improved tension leg joint 10 includes receptacle 12 which is supported in a well known and usual manner from the anchor template (not shown) positioned in anchoring relationship to the sea floor (not shown), and tendon or tension leg 14 which is shown to be in the initial phase of entering the upper end of receptacle 12, latching means 16 and release means 18. Receptacle 12 includes tubular body 20 which has bore 22 extending upward in its lower end up to the lower end of recess or counterbore 24 which is defined by lower shoulder 26 which faces upwardly. Fins 28 are positioned within bore 22 as shown and support lower guide plate 30 which is frustoconical in shape and adapted to engage and guide the lower end of tendon 14 as hereinafter described. The upper end of recess 24 ends in downwardly facing shoulder 32. The upper interior of body 20 continues above shoulder 32 with straight bore 34. Fins 36 are secured to the exterior of body 20 in supporting relationship to upper guide plate 38 which is generally frusto-conical in shape as is the upper surface 40 of body 20 to assist in the entry of tendon 14 into receptacle 12.

Tendon 14 is shown to be a tubular member but may be a solid rod-like member depending upon the design requirements for the particular installation. The lower end of tendon 14 is engaged with spherical surface 42 supported on plate 44 from stinger 46. Stinger 46 includes tubular extension 48 secured at its upper end to frusto-conical support 50 to which plate 44 is secured. Resilient mounting means 52 is shown positioned between the exterior outer surface 54 on the lower end of tendon 14 and the lower interior of latch support ring 56 as shown. Such resilient mounting means 52 may be any suitable means providing the desired degree of freedom of movement between the components. Latch support ring 56 has its lower end supported by the upper end of support 50 and includes an exterior configuration including upper cylindrical surface 58 on which sealing ring 60 is mounted by suitable threads in approximately the center portion thereof, downwardly and outwardly tapered surface 62, short cylindrical surface 64 which ends in latching shoulder 66 and lower cylindrical surface 68 below shoulder 66 which has a diameter which is smaller than the diameter of bore 34 of receptacle 12 so that ring 56 passes readily therethrough when it is properly aligned with the axis of receptacle 12. Latching or latch element 70 is normally mounted in position around surface 64 and in engagement with shoulder 66. In the form of latching element shown in FIGS. 1 to 8, it is a split ring which is biased to have a free position substantially as shown in FIG. 1 but have sufficient freedom of contraction so that it will move into tight engagement around the lower portion of cylindrical surface 58 below sealing ring 60 as hereinafter described and shown.

Figure 2:
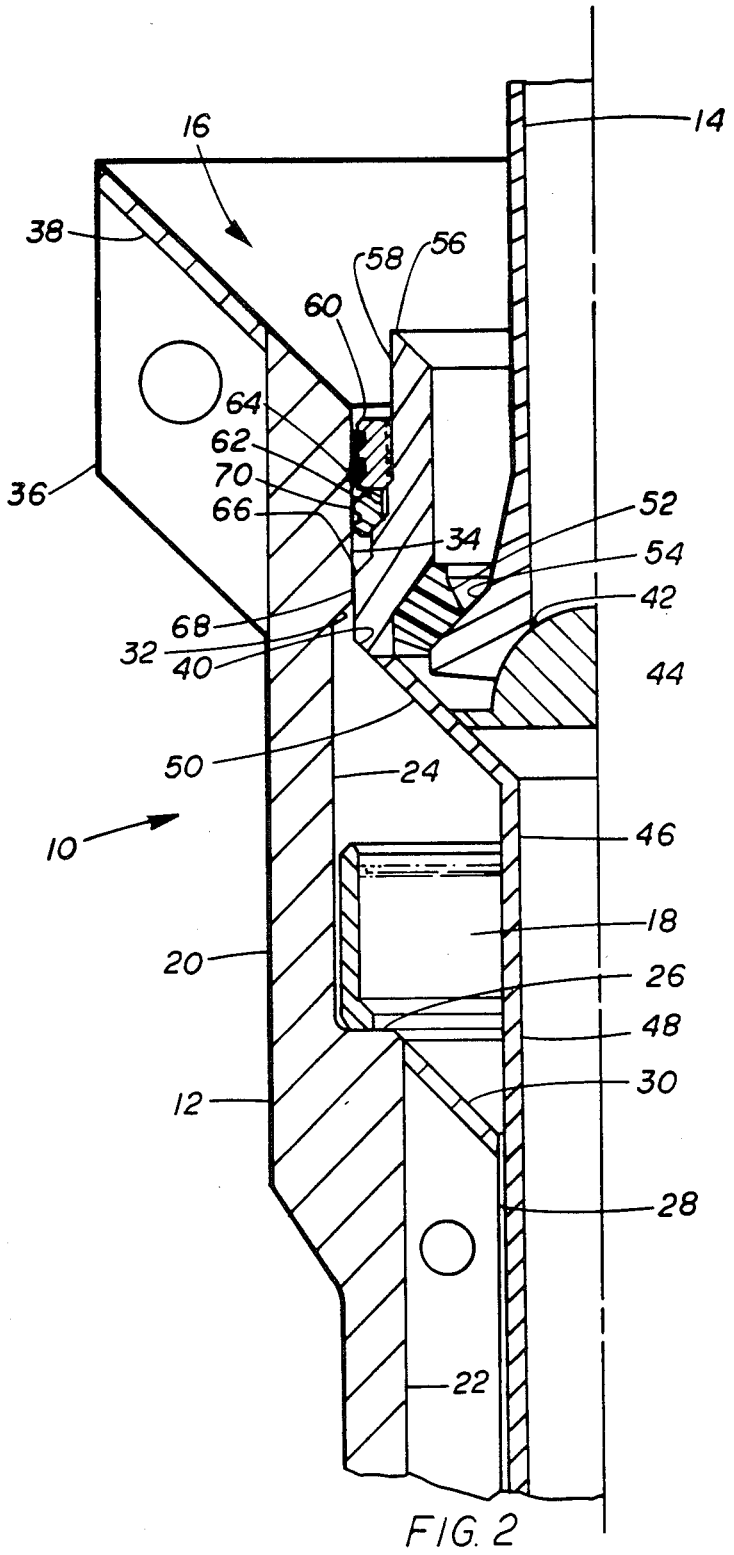
FIG. 2 is another partial sectional view of the invention form shown in FIG. 1 but showing the entry of the tension leg into the receptacle.

In operation, tension leg 14 is lowered into the upper end of receptacle 12 as shown in FIG. 1. In this position, tension leg 14 has stinger extension 48 positioned partially within lower guide plate 30 and has its axis at an angle to the axis of receptacle 12. The coaction of stinger extension 48 and plate 50 with lower guide plate 30 and upper surface 40 of body 20 during continued lowering of tension leg 14 brings the two axes into registry with each other and further allows the entry of latch support ring 58 within bore 34 of body 20. Its entry therein causes seal ring 30 to come into engagement with the wall of bore 34 and also cams latch element 70 upward from surface 64 and inward into engagement with surfaces 62 and 58 as shown in FIG. 2.

Figure 3:
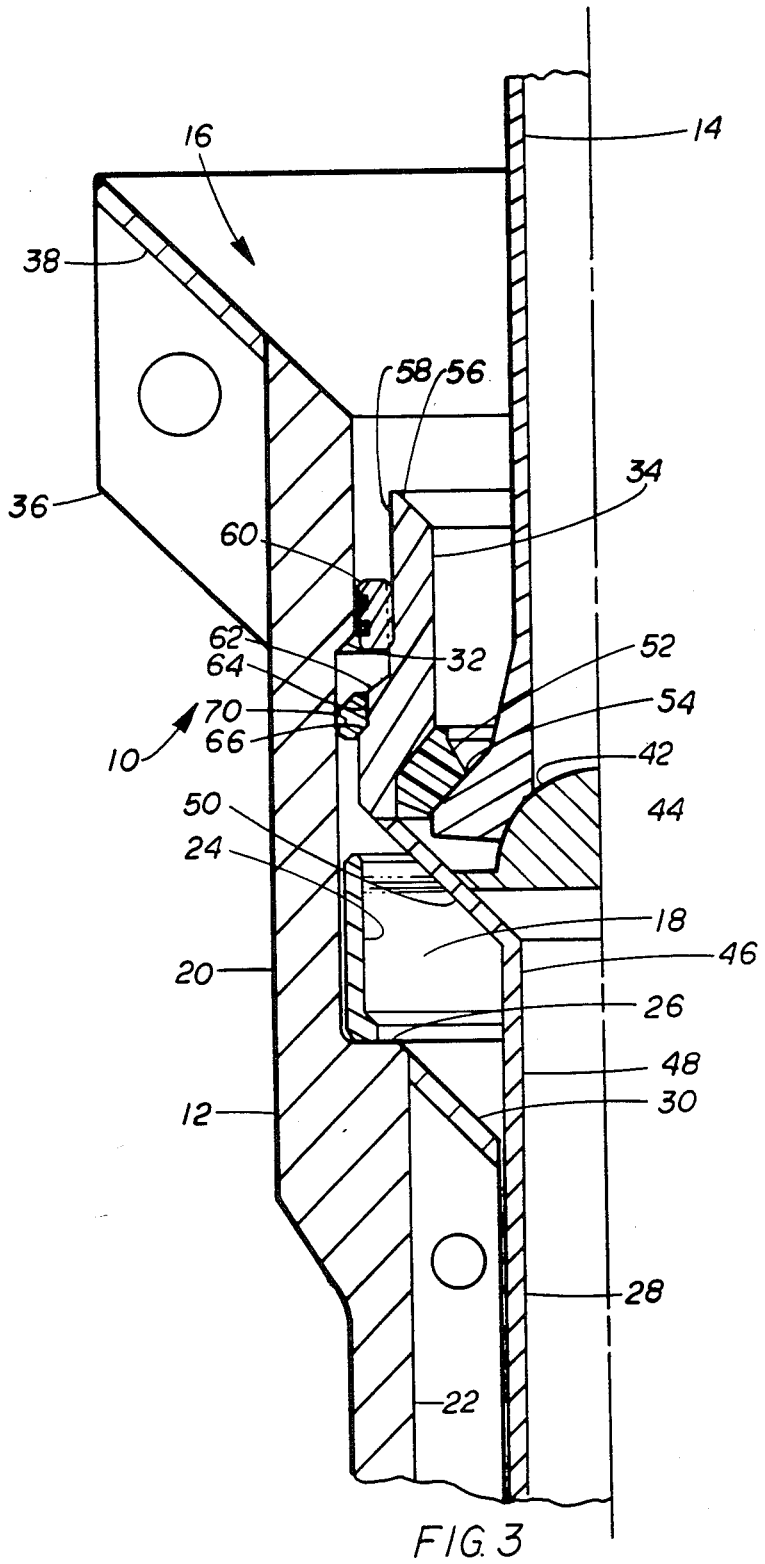
FIG. 3 is another similar view showing the entry of the tension leg into the receptacle sufficiently to release the latching element for latching engagement with the upper downwardly facing shoulder of the internal latching recess in the receptacle.
Figure 4:
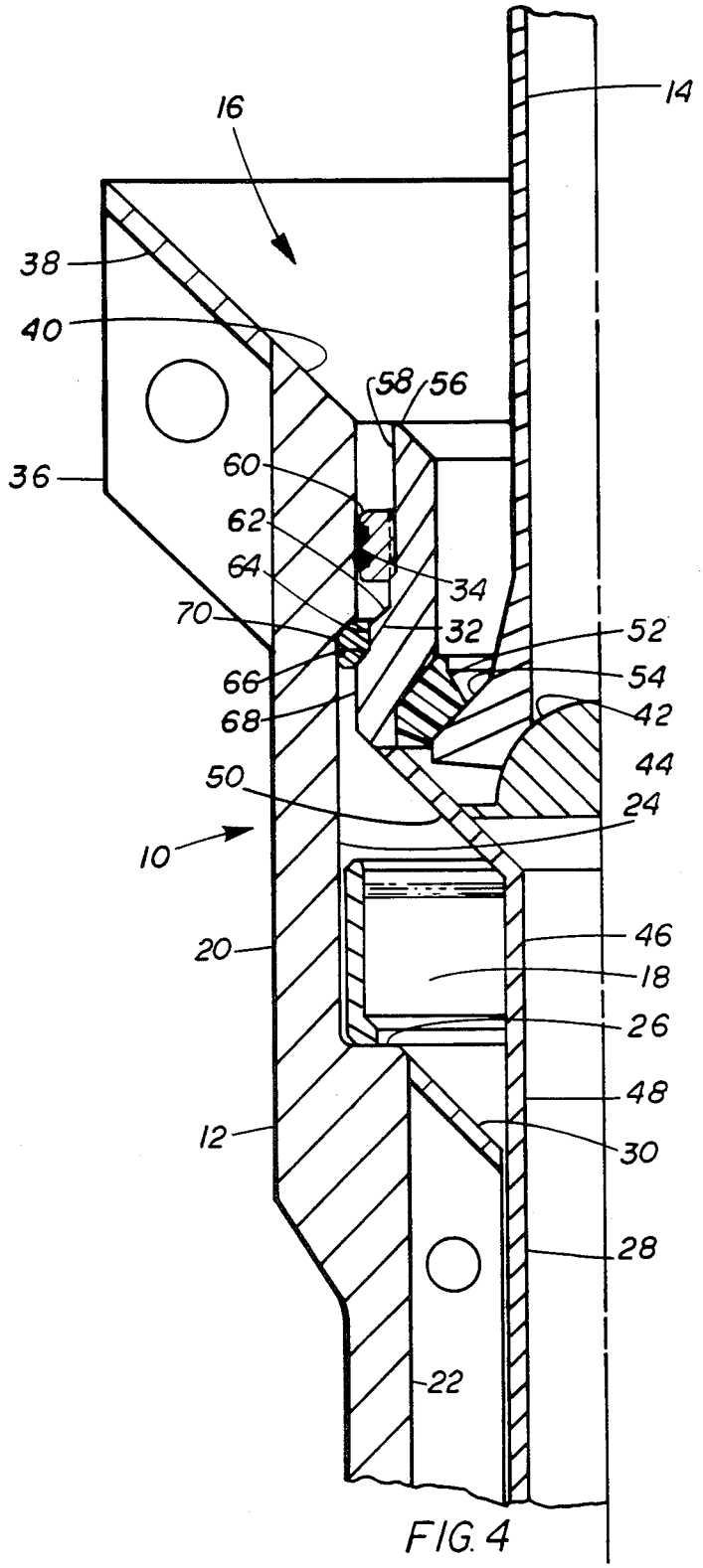
FIG. 4 is another similar view showing the latched position of the tension leg after it is in tension.

Downward movement of tension leg 14 to the position shown in FIG. 3 frees latch element 70 so that it expands to its free diameter and drops into engagement with latching shoulder 66. At this point the lowering of tension leg 14 is stopped and tension is applied to leg 14 so that it moves upward bringing latch element 70 into engagement with shoulder 32 to securely latch tension leg 14 in this position as shown in FIG. 4. The desired degree of tension may then be applied to tension leg 14 which will provide the mooring desired for the floating structure (not shown) to which tension leg 14 extends.

Figure 5:
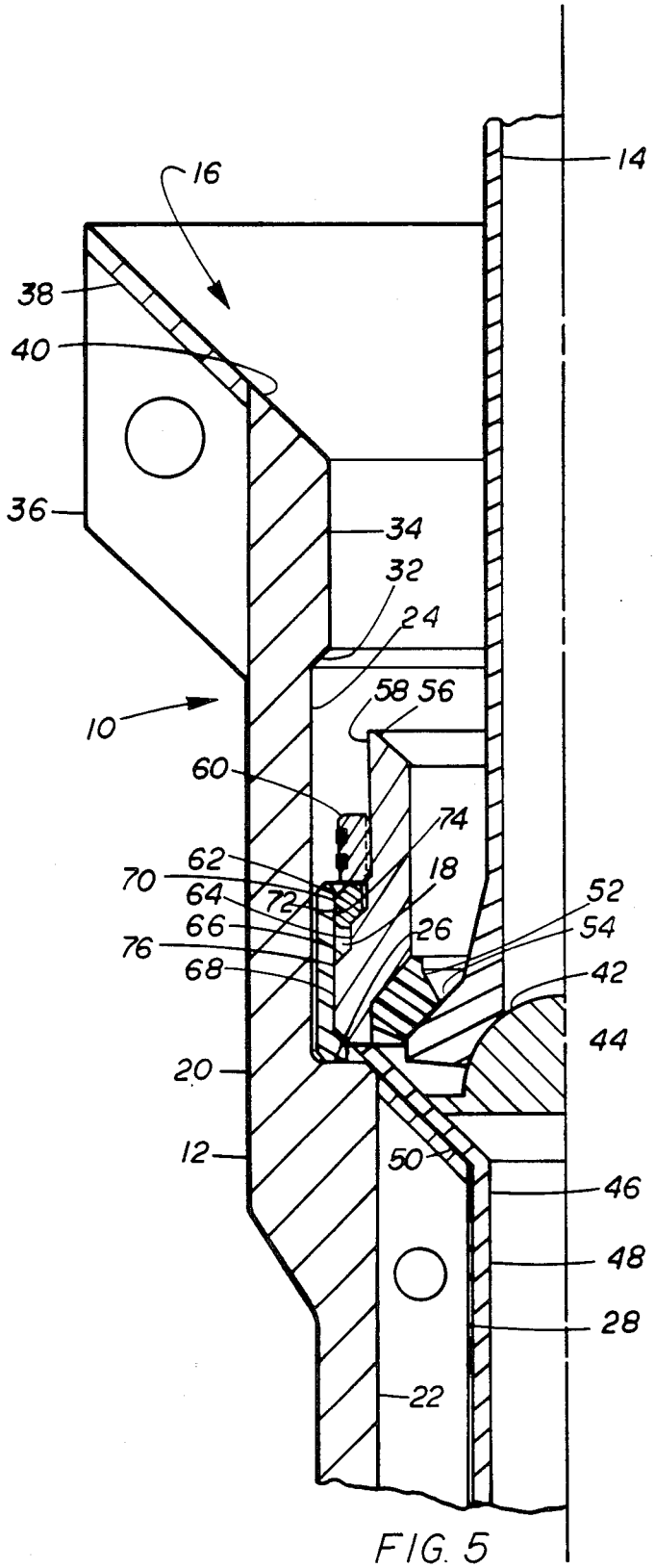
FIG. 5 is another similar view showing the lowering of the tension leg to the lower end of the receptacle recess to provide engagement between the latching element and the release element.
Figure 6:
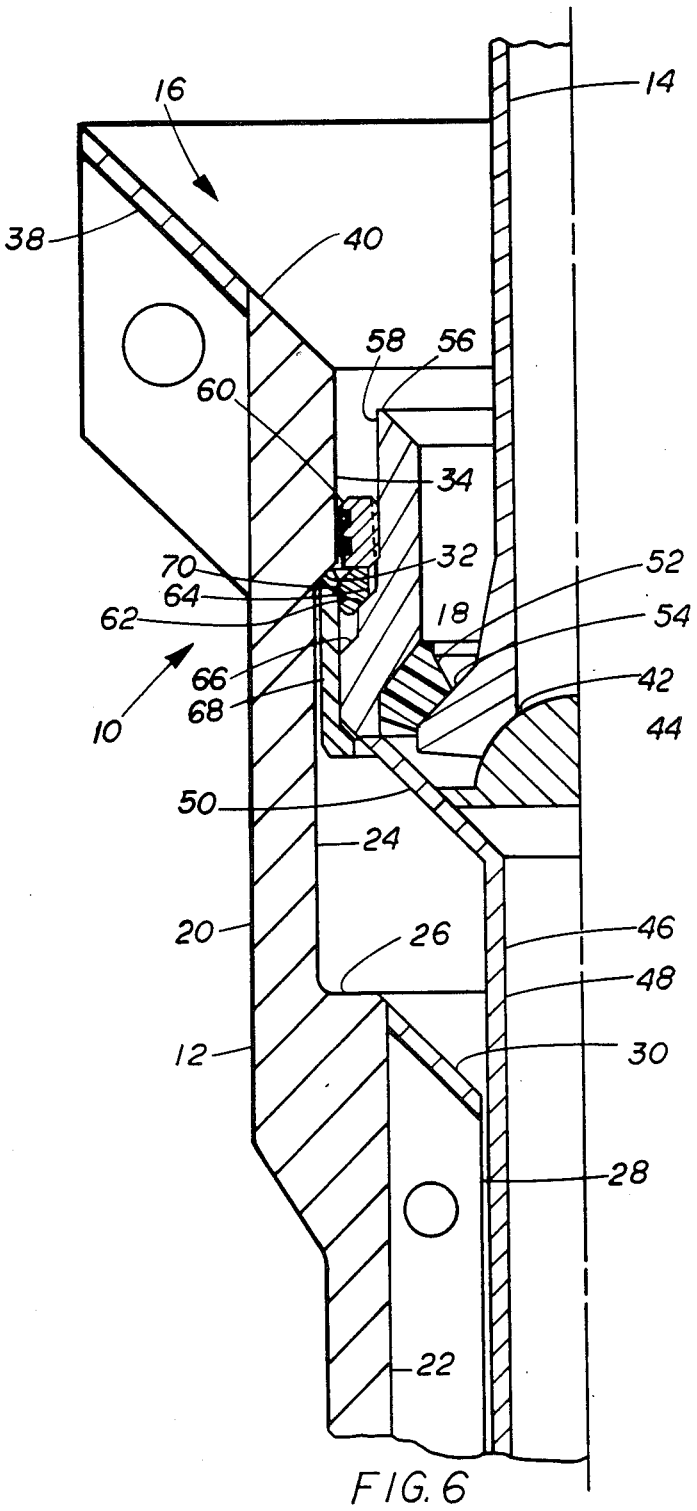
FIG. 6 is another similar view showing the lifting of the tension leg with the latching element still in engagement with the release element and the release element in engagement with the upper internal receptacle recess shoulder.
Figure 7:
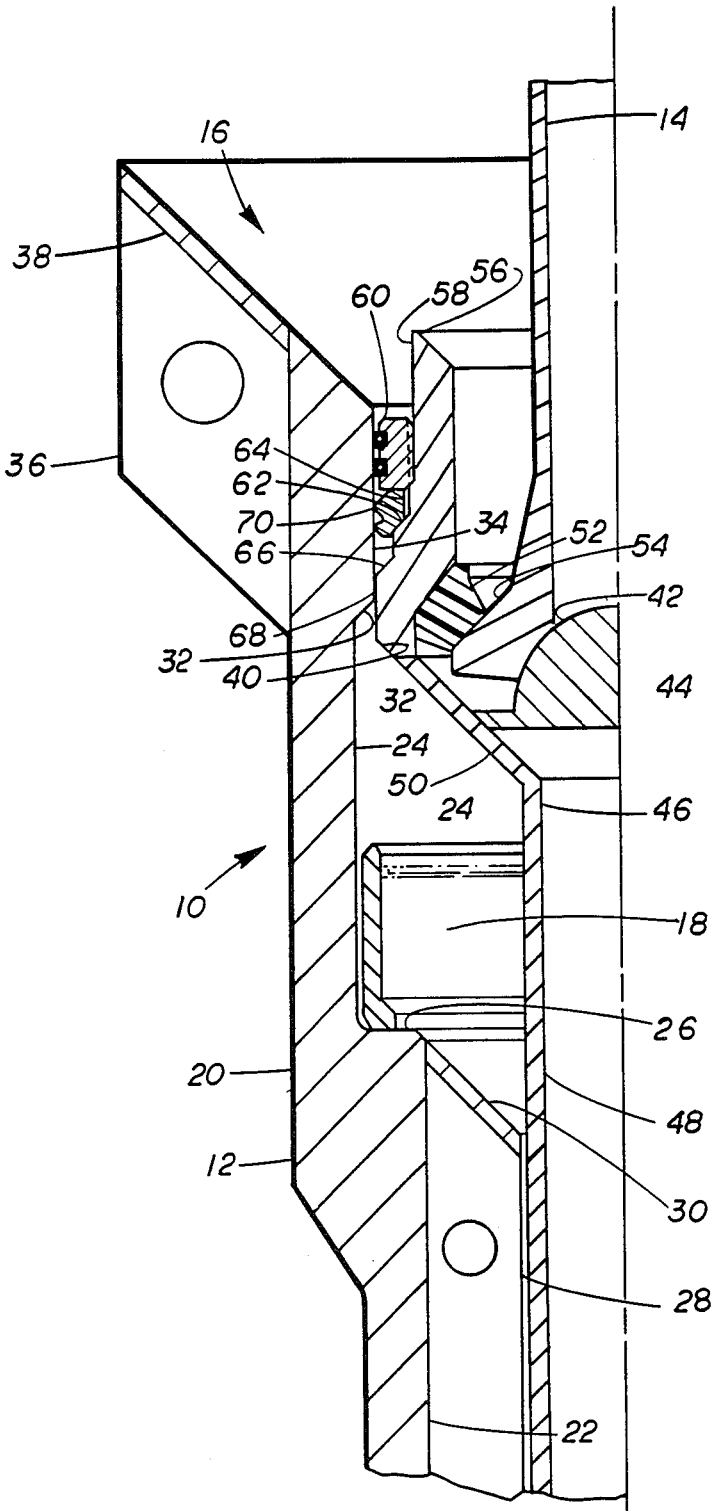
FIG. 7 is another similar view showing the movement of the tension leg and its latching element through the upper bore of the receptacle and the return of the release element to the lower shoulder of the internal receptacle recess.
Figure 8:
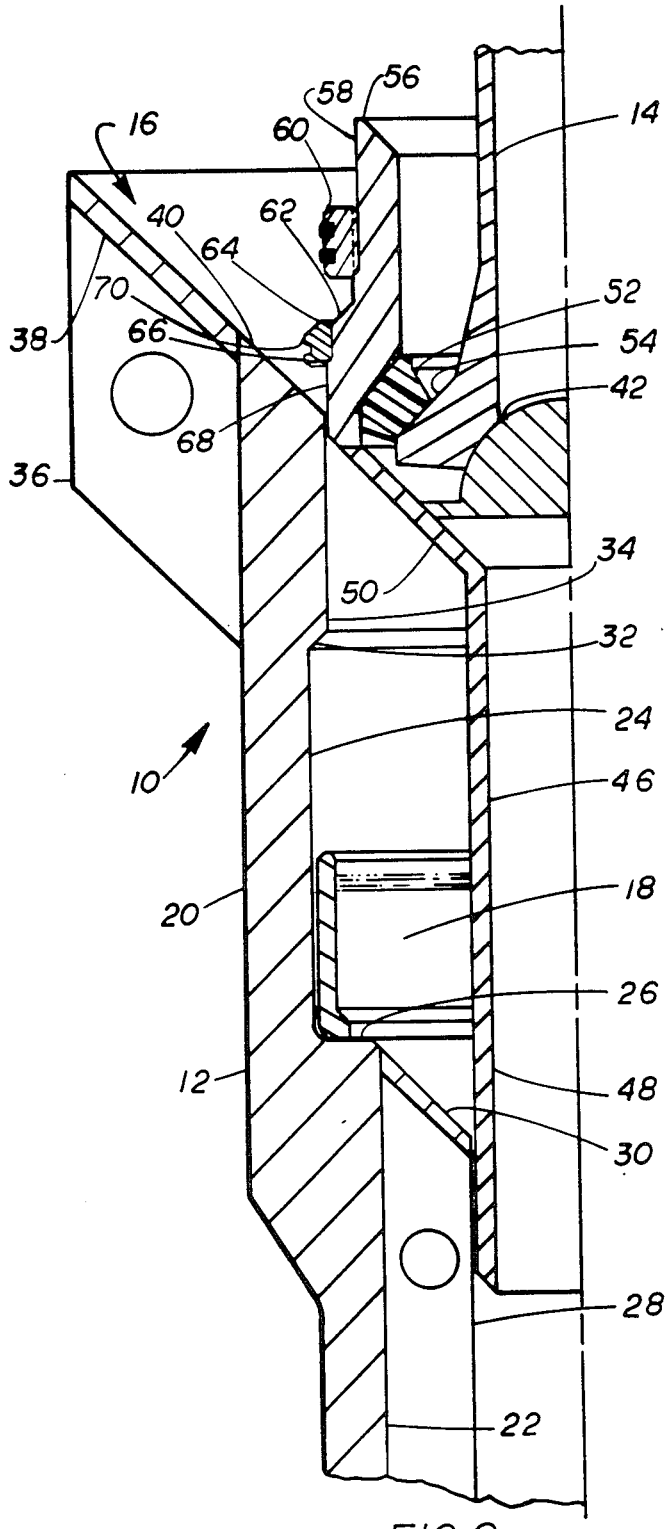
FIG. 8 is another similar view showing the retrieval of the tension leg and its latching element as they are retrieved from the upper end of the receptacle bore.

In the event it is desired to recover tension leg 14 from its engagement within receptacle 12, it is only necessary to release tension leg 14 from tension and allow it to be lowered within receptacle 12 to the position illustrated in FIG. 5. In this position latch element 70 has been moved above surface 64 and cammed into engagement with tapered surface 62 and upper cylindrical surface 58. Additionally the exterior of latch element 70 which includes groove 72 has been moved into engagement with the knurled surface 74 on the interior of release sleeve 76. Release sleeve 76 in its inactive position rests on shoulder 26 until engaged by latch element 70. After the projecting exterior portions of latch element 70 above and below groove 72 have engaged knurled surface 74 on release sleeve 76 as shown in FIG. 5, tension leg 14 is raised. During the raising of tension leg 14, release sleeve 76 is also raised until it contacts shoulder 32 as shown in FIG. 6. This engagement prevents further upward movement of release sleeve 76 and then latching ring 56 together with seal ring 60 and latching element 70 move upward through the interior of bore 34 as shown in FIG. 7. In this position, latching element 70 has disengaged from the interior of release sleeve 76 and it has dropped within recess 24 downward into resting engagement with lower shoulder 26. Thereafter the retrieval of tension leg 14 is completed by simply raising it and it exits from the interior of receptacle 12 as shown in FIG. 8 and is recovered to the surface or reconnected as desired.

It should be noted that release sleeve 76 with its inner knurled surface 74 or other suitable surface which provide sufficient friction force between sleeve 76 and latching element 70 for the lifting of sleeve 76 into engagement with upper shoulder 32 functions as release means 18, allowing complete release of the latched engagement between the lower end of tension leg 14 and receptacle 12.

The modified form of tension leg joint 80 shown in FIGS. 9, 10, 11 and 12 is similar to joint 10 but its latching means 82 which secures the lower end of tension leg 84 within the interior of receptacle 86 is a different structure. Receptacle 86 includes tubular body 88 having external fins 90 in supporting relationship to upper guide plate 92 which is integral with body 88 or may be suitably secured thereto, as by welding, to provide an upward and outward continuation of upper tapered surface 94 of body 88. Lower bore 96 of body 88 extends upward to intersect with surface 98 which tapers upwardly and outwardly and extends to upwardly facing shoulder 100. Shoulder 100 forms the lower end of internal recess 102 within body 88 which extends upwardly to downwardly facing shoulder 104. Shoulder 104 is formed in insert 106 which is of a harder material than body 88 so that it resists coining during when it is subjected to the tension loads applied thereby by the latching means 82 as hereinafter explained. Bore 108 above shoulder 104 is straight and intersects with the inner edge of surface 94 as shown.

Tension leg 84 includes spherical surface 110 which is engaged by the lower interior of leg 84 and provides a centering of leg 84 as it moves in pivoting relationship thereabout. Resilient mounting means 112 engages the interior of latching ring 114 and provides the freedom of movement required by slight angular misalignments which occur in the use of tension leg 84. Resilient mounting means 112 is similar to resilient mounting means 52 previously described. Spherical surface 110 is provide by ball segment 116 which is mounted on support plate 118 which in turn is secured to the lower exterior of latching ring 114 and stinger 120 extends downwardly therefrom as shown.

Latching element 122, in the form of the invention illustrated in FIGS. 9 through 12, is a latch ring 124 having a plurality of flexible fingers 126 depending from ring 124. Fingers 126 include strip 128 extending from the lower end of ring 124 to the enlarged end 130 of fingers 126. Enlarged end 130 includes lower inner tapered surface 132 and upper outer tapered surface 134. Annular plate 136 is secured to the upper end of latch ring 124 by suitable fastening means 138, such as cap screws, and extends outwardly therefrom to provide a stop to the upward movement of latch ring 124. As best seen in FIG. 9A, upper exterior surface 140 on latching ring 114 tapers downwardly and slightly inwardly to upwardly facing shoulder 142. Surface 144 immediately below shoulder 142 tapers downwardly and outwardly and in the latched position engages lower inner tapered surface 132 on enlarged end 130 of fingers 126. Cylindrical surface 146 extends downward below surface 144 and has a diameter which is sufficiently small to allow latching ring 114 to pass through bore 108.

Figure 9:
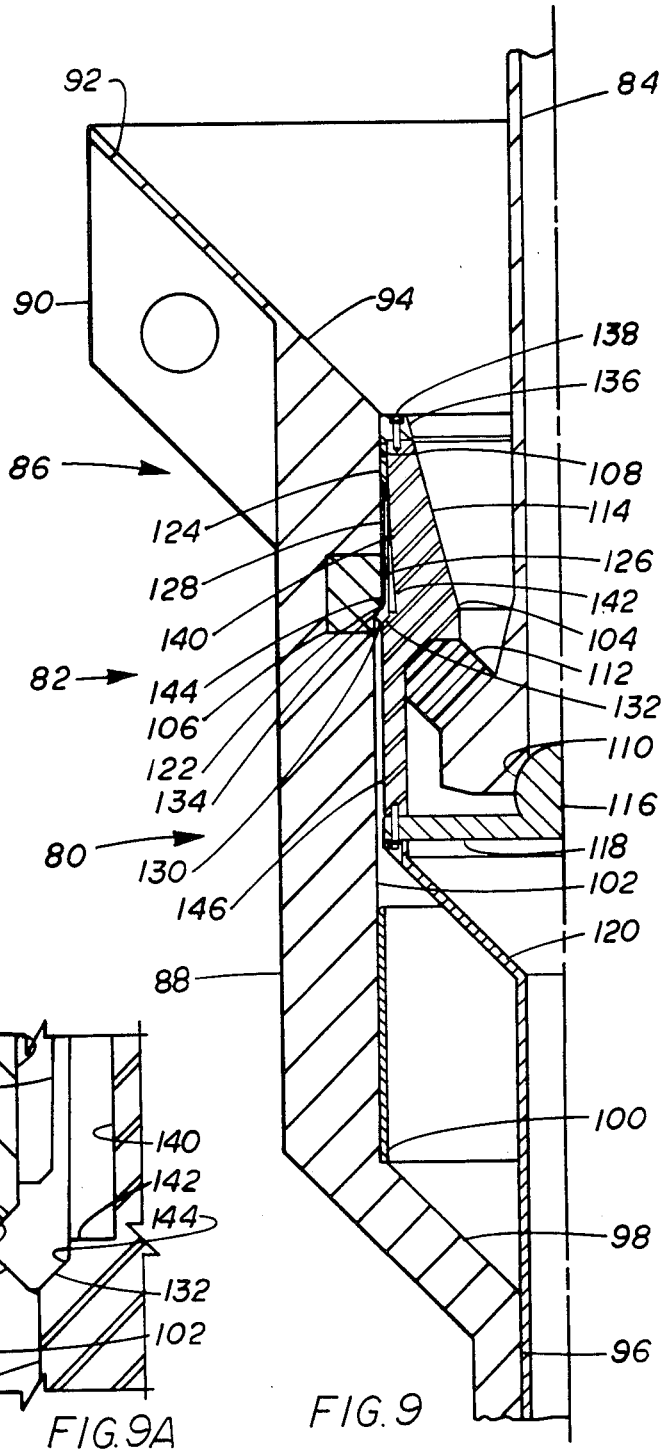
FIG. 9 is another similar view of another form of the present invention showing the tension leg latched within the receptacle.
Figure 9A:
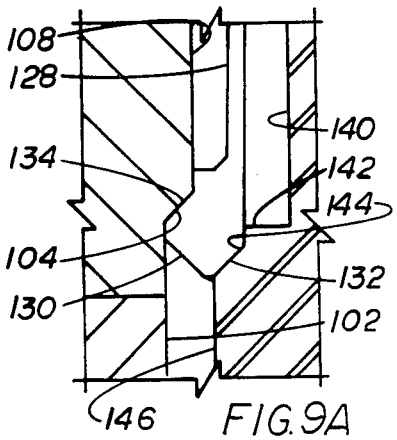
FIG. 9A is a partial detail sectional view of the structure of the latching fingers and their position with respect to the latching shoulders when they are in latching engagement.
Figure 10:
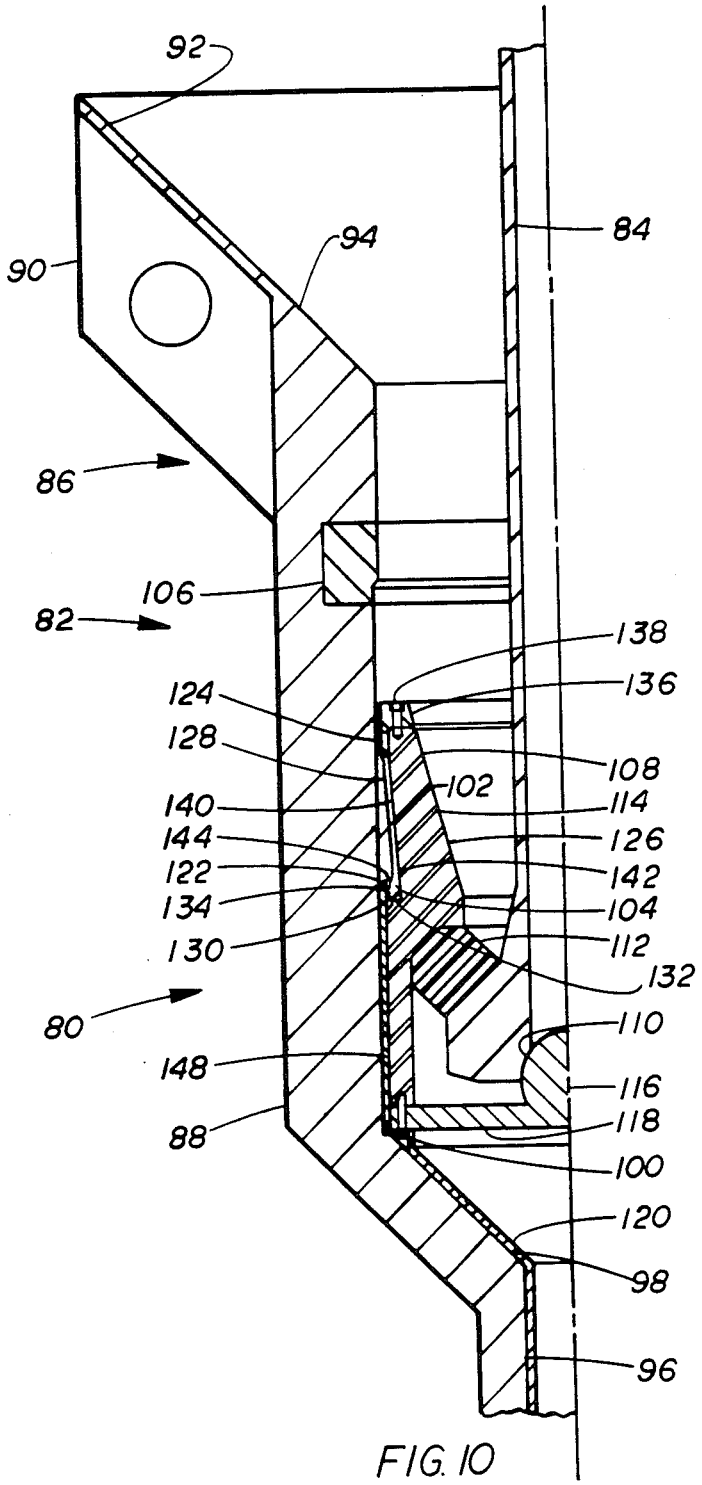
FIG. 10 is another similar view of the structure of FIG. 9 with its latching element engaged by the release element.

Latching means 82, as shown in FIG. 9, is in the latched position with enlarged end 130 of fingers 126 engaged between shoulder 104 and tapered surface 144. In this position tension leg 84 is under tension and the upper end of latch ring 124 is spaced downwardly from the overhanging portion of annular plate 136.

As previously stated, tension leg 84 which is shown to be a tubular member may be a solid tension member without departing from the features of the present invention.

In operation, tension leg 84 is lowered into bore 108 of receptacle 86 and the engagement of the lower end of fingers 126 causes latching element 122 to move upward until its ring 124 engages the underside of annular plate 136. When it has moved this far, enlarged end 130 of fingers 126 is positioned to be cammed into the lower portion of tapered surface 140 above shoulder 142. This allows latching means 82 to pass through bore 108. When the lower enlarged ends 130 of fingers 126 have entered recess 102 below shoulder 104, the force holding fingers 126 bent inwardly is release and enlarged ends 130 move outwardly. Thereafter, upward movement of tension leg 84 causes the lower inner surface 132 of enlarged end 130 to be engaged by tapered surface 144 and further upward movement brings tapered surface 134 into engagement with shoulder 104 thus completing the latching of latching means 82 which is illustrated in FIGS. 9 and 9A.

Figure 11:
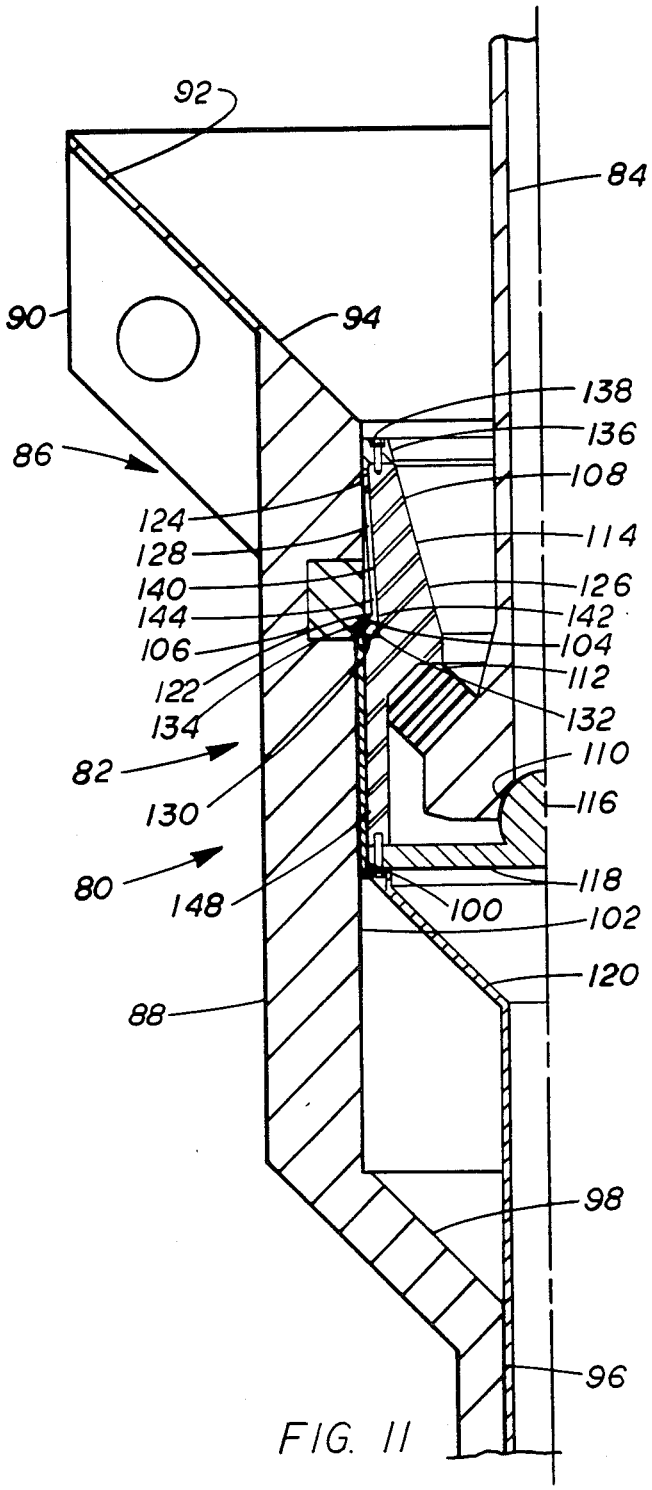
FIG. 11 is another similar view of the structure of FIG. 9 illustrating the release element retaining the latching element out of latching engagement with the upper internal receptacle recess shoulder to allow full retrieval of the tension leg and its latching element therefrom.

Release sleeve 148 is positioned within recess 102 on shoulder 100. When it is desired to disengage tension leg 84 from receptacle 86, tension leg 84 is lowered to the position illustrated in FIG. 10 so that enlarged ends 130 of fingers 126 are positioned within release sleeve 148 and the lower end of fingers 126 are positioned immediately above shoulder 142. The raising of tension leg 84 raises release sleeve 148 with latching element 122 which being release sleeve 148 into engagement with shoulder 104 as shown in FIG. 11. Further upward movement causes enlarged ends 130 of fingers 126 to pass into bore 108 and be retrieve therefrom without any possibility of latching means 82 moving into set position.

Figure 12:
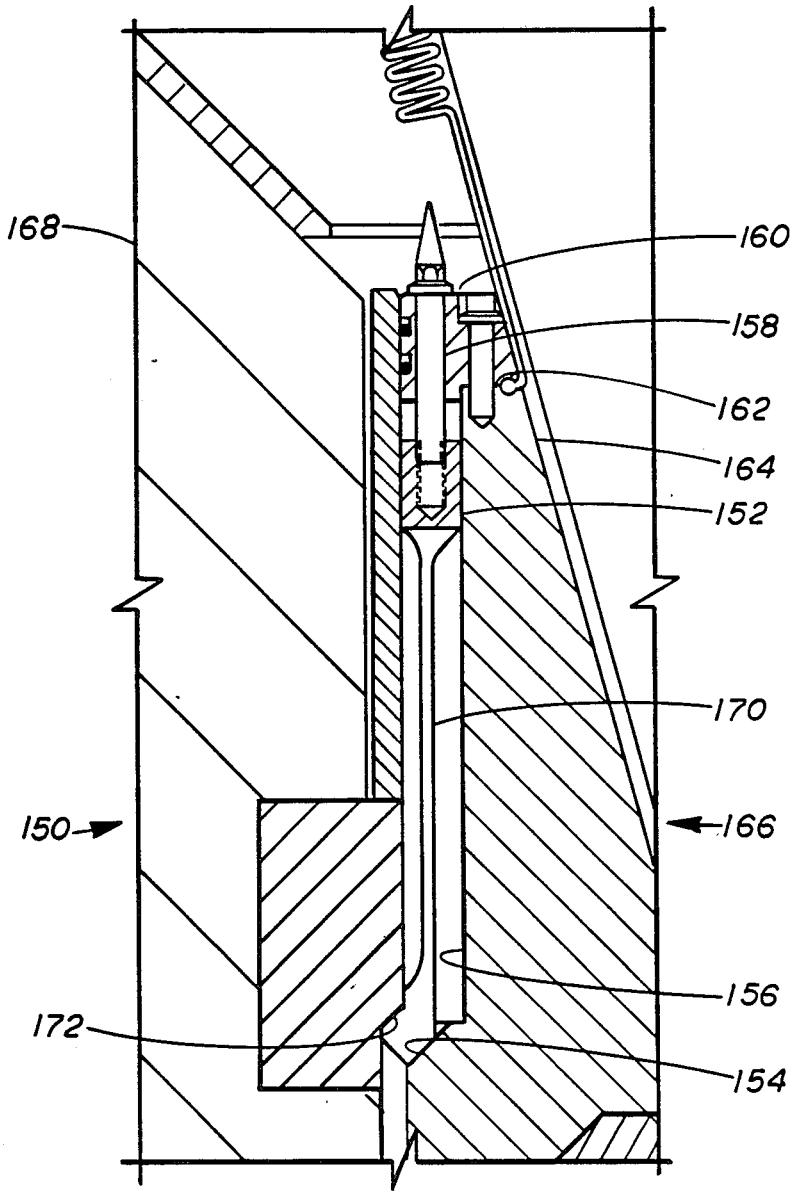
FIG. 12 is another similar sectional view of still another modified form of the improved joint having a mechanical release mechanism in the event the normal release means is inoperative.

Joint 150 shown in FIG. 12 is substantially the same as joint 80 except that separate release means are provided so that latching element 152 may be retracted from its latched position upward into the recess above shoulder 154 at the lower end of outer inwardly tapered surface 156. This is accomplished by the operation of bolts 158 which extend through annular plate 160 which is secured to the upper end 162 of latching ring 164. Bolts 158 are operated by divers or a remote operated vehicle and function to raise latching element 152 to its retracted position. This is possible since the tension will be released on tension leg 166 which allows latching ring 164 to move downward in receptacle 168 sufficiently so that the lower end of fingers 170 are cammed inwardly to their released position by their upward movement against upper shoulder 172. This allows full release of latching element 152 to allow retrieval of tension leg 166 from receptacle 168 even in the event that release sleeve 174 has become inactive and cannot be moved upwardly by the engagement of fingers 170 therein.

What is claimed is:

1. A tension leg joint comprising a receptacle having an enlarged end, an upper surface tapering inwardly and away from the enlarged end, an upper bore at the inner portion of said upper surface and extending downwardly therefrom, a recess below said first bore and having an enlarged diameter with respect to said first bore, an upper downwardly facing shoulder at the upper end of said recess, a lower upwardly facing shoulder at the lower end of said recess and a bore below said upwardly facing shoulder extending through the remainder of said receptacle, a tension leg having an end which is landed within said upper bore in said enlarged end of the receptacle, said tension leg end having a lower upwardly facing external shoulder between a larger external diameter surface and an intermediate external surface which is smaller than said larger surface, and an upper upwardly facing external shoulder, between said intermediate external surface and a smaller external diameter surface, a latching element normally biased outwardly for seating on said lower upwardly facing external shoulder and extending radially outward of said larger external diameter surface of said tension leg end to provide a latch when positioned in engagement with said receptacle recess downwardly facing shoulder, a release ring positioned within said receptacle recess and having a tubular shape with an inner surface whose internal diameter which is slightly larger than the largest outer diameter of said tension leg end, the lowering of said tension leg end into said upper bore in the enlarged end of said receptacle lowers said latching element into engagement between said upper recess shoulder and said lower external shoulder on said tension leg end to latch said tension leg into engagement within said receptacle while the joint is maintained in tension, the lowering of said tension leg from its latched position providing engagement between said latching element and said roughened inner surface of said release ring to move said latching element into position on said upper shoulder on said tension leg end with the engagement of the release ring by said latching element, and means coacting between said latching element. and said release ring to maintain said engagement during the upward movement of said release ring and said latching element until said latching element clears said upper recess shoulder to thereby allow tension leg to be retrieved from said receptacle and engagement of said retainer ring with said upper recess shoulder allowing said tension leg end to pass therethrough as it is being retrieved.

2. A tension leg joint according to claim 1 wherein said latching element is a split ring having upper and lower surface to mate with said upper recess shoulder and said lower tension leg shoulder.

3. A tension leg joint according to claim 1 wherein said latching element is a ring having a plurality of integral depending flexible fingers with latching surfaces on their ends.

4. A tension leg joint according to claim 1 including means flexibly mounting said tension leg within said tension leg end.

5. A tension leg joint according to claim 1 including mechanical means for positive releasing of said latching element from the exterior of said tension leg end.

6. A tension leg joint according to claim 1 including a surface on the interior of said release ring for retaining engagement with said latching element during removal of said latching element from within said receptacle recess.

7. A tension leg joint comprising a receptacle having an enlarged end, an upper surface tapering inwardly and away from the enlarged end, an upper bore at the inner portion of said upper surface and extending downwardly therefrom, a recess below said first bore and having an enlarged diameter with respect to said first bore, an upper downwardly facing shoulder at the upper end of said recess, a lower upwardly facing shoulder at the lower end of said recess and a bore below said upwardly facing shoulder extending through the remainder of said receptacle, a tension leg having an end which is landed within said enlarged end of the receptacle, said tension leg end having a lower upwardly facing external shoulder between a larger external diameter surface and an intermediate external surface which is smaller than said larger surface, and an upper upwardly facing external shoulder, between said intermediate external surface and a smaller external diameter surface, a latching element normally biased outwardly for seating on said lower upwardly facing external shoulder and extending radially outward of said larger external diameter surface of said tension leg end to provide a latch when positioned in engagement with said receptacle recess downwardly facing shoulder, a release ring positioned within said receptacle recess and having an internal diameter which is slightly larger than the largest outer diameter of said tension leg end, the lowering of said tension leg end into the enlarged end of said receptacle lowers said latching element into engagement between said upper recess shoulder and said lower external shoulder on said tension leg end to latch said tension leg into engagement within said receptacle while the joint is maintained in tension, the lowering of said tension leg from its latched position providing engagement between said latching element and said release ring to move said latching element into position on said upper shoulder on said tension leg end with the engagement of the release ring by said latching element and maintain said engagement to thereby allow tension leg to be retrieved from said receptacle and engagement of said retainer ring with said upper recess shoulder allowing said tension leg end to pass therethrough as it is being retrieved, mechanical means for positive releasing of said latching element from the exterior of said tension leg end, said mechanical means including, a plate secured to the upper end of said tension leg end, and threaded means extending through said plate and threading into said latching element so that manual rotation of said threaded means causes said latching element to be raised to the level with its lower shoulder positioned to be above said tension leg upper shoulder to allow retrieval of said tension leg from said receptacle in the event said release ring is inoperative.

8. A joint for a tension leg comprising a first tubular member having an enlarged end with an upper bore near its enlarged end extending therein to a recess forming an inwardly facing shoulder as the transition from said upper bore to said recess and a lower bore at the end of the recess forming an upwardly facing shoulder as the transition from said recess to said lower bore, a second member having an insert end to be received within the upper bore in the enlarged end of said first tubular member, said second member having a first outer surface at said insert end, a second surface of smaller diameter than said first outer surface spaced from such insert end by a first shoulder, a third surface of smaller diameter and spaced from said second surface by a second shoulder, a latching member mounted on said second member having a free inner diameter slightly larger than the diameter of said second outer surface of said second tubular member, said latching member being radially and axially movable on said second member, a tubular release ring positioned within said recess in said first tubular member, said release ring having an inner surface with a diameter approximately the same as the diameter of said upper bore of said first member and at least a portion of said inner surface being roughened as a means for providing releasable engagement with said latching member whereby movement of said latching member within said release ring moves said latching member to the position around said third surface on the exterior of said second member and into tight engagement with said release ring to allow removal of said second member from within said first tubular member with said latching member mounted on said third surface, movement of said second member into said upper bore in the enlarged end of said first tubular member causing said latching member to move onto said third surface to pass through said upper bore and when it is positioned within said recess of said first member to expand to be positioned between said inwardly facing shoulder between said upper bore and said recess and said first shoulder on said second member to latch said second member within said first member.

* * * * *